US006912942B2

(12) United States Patent
Flament

(10) Patent No.: US 6,912,942 B2
(45) Date of Patent: Jul. 5, 2005

(54) METHOD AND DEVICE FOR REMOVING PARTICLES FROM WEBS OF MATERIAL

(75) Inventor: Daniel Flament, Igny (FR)

(73) Assignee: Goss International Montataire S.A., Montataire (FR)

( * ) Notice: Subject to any disclaimer, the term of this patent is extended or adjusted under 35 U.S.C. 154(b) by 523 days.

(21) Appl. No.: 09/775,041

(22) Filed: Feb. 1, 2001

(65) Prior Publication Data

US 2001/0017144 A1 Aug. 30, 2001

(30) Foreign Application Priority Data

Feb. 1, 2000 (DE) ..... 100 04 305
Sep. 13, 2000 (FR) ..... 0011643

(51) Int. Cl.[7] ..... B26D 7/18

(52) U.S. Cl. ..... 83/100; 83/101; 83/102; 83/105

(58) Field of Search ..... 83/100, 101, 105, 83/102, 168, 407, 408, 658, 659

(56) References Cited

U.S. PATENT DOCUMENTS 1,313,325 A * 8/1919 Nordyke et al. ..... 83/322
1,574,633 A * 2/1926 Myover ..... 83/101
3,880,047 A * 4/1975 Dosier ..... 409/134
4,003,276 A * 1/1977 Schmitt ..... 83/100
4,835,808 A 6/1989 Hahne et al.
5,036,737 A 8/1991 Glaser
5,950,510 A * 9/1999 Scheffer et al. ..... 83/23
6,061,865 A * 5/2000 Susnjara et al. ..... 15/301

FOREIGN PATENT DOCUMENTS

| | | |
|---|---|---|
| DE | 631 858 | 5/1933 |
| DE | 39 14 310 C2 | 10/1990 |
| DE | 39 17 845 C2 | 12/1990 |
| DE | 40 23 257 C2 | 1/1992 |
| DE | 42 29 699 C2 | 3/1994 |
| EP | 0 245 526 A1 | 11/1987 |
| EP | 0 858 889 A2 | 8/1998 |
| EP | 0 887 160 A2 | 12/1998 |
| GB | 2 240 843 A | 8/1991 |
| JP | 10 029 746 A | 2/1998 |

* cited by examiner

*Primary Examiner*—Kenneth E. Peterson
*Assistant Examiner*—Omar Flores Sánchez
(74) *Attorney, Agent, or Firm*—Laurence A. Greenberg; Werner H. Stemer; Ralph E. Locher

(57) ABSTRACT

A method for removing from at least single-layer webs of material, particles formed by slitting devices which are arranged along a web travel path in a slitting zone, includes generating a suction zone associated with the slitting devices in accordance with the position of a cutting location; a device for performing the method; a jobbing web-fed rotary printing machine including the device; and a newspaper rotary printing machine including the device.

16 Claims, 4 Drawing Sheets

METHOD AND DEVICE FOR REMOVING PARTICLES FROM WEBS OF MATERIAL

BACKGROUND OF THE INVENTION

Field of the Invention

The invention relates to a method and a device for removing particles from webs of material, for example from single-layer or multilayer webs of material which, printed, respectively, on the top and bottom sides thereof, move past variably positionable slitting devices.

The published Japanese Patent Document JP-10 029 746 A discloses a spreader roller which is driven in circumferential direction by a drive and which, in addition to the spreading function, is used to remove paper dust particles from a web of material. The surface of the spreader roller, which simultaneously serves to remove paper dust particles, is provided with helically encircling grooves which, starting from the center of the spreader roller, run in opposite direction to the latter. Cross-pieces which delimit the helical grooves may either be formed of flexible plastic material or from lines of brushes extending in the circumferential direction of the roller.

The published European Patent Document EP 0 245 526 A1 is concerned with a device for removing dust from moving surfaces, in particular moving surfaces of paper. In the dust removal device, a nozzle out of which a gas, Preferably air, flows, is arranged opposite a web of material. The device also has a duct via which air containing the particles which have been sucked up can be extracted; also a high-voltage electrode which may be of either punctiform or linear construction. The high-voltage electrode extends in a first plane which is not parallel to the web of material moving past it. The nozzle may be arranged in either punctiform or elongate configuration, connected in series, while the blowing device extends in a second plane lying downline of the high-voltage electrode, as viewed in the travel direction of the web of material. The two planes mutually intersect in a straight line lying in the travel plane of the material web, perpendicularly to the web travel direction. As viewed in the web travel direction, the punctiform or linear openings extend in front of the high-voltage electrode.

The published European Patent Document EP 0 858 889 A2 is concerned with a dust removal system with a sheet-guiding device which, in a conveying direction of the printed matter, is arranged in front of a pressure zone, the dust removal system being constructed in the form of a suction box with brushes arranged at least in upper and lower regions thereof and being coupled to a suction air source. At least one blow or blast tube, which is so connected in that it extends parallel to the axis of an impression cylinder and over the circumferential surface thereof, with openings which are directed approximately oppositely to the conveying direction, is arranged upline of the dust removal system, as viewed in the conveying direction. It is possible to generate a blowing air flow which is directed in the blowing direction onto the circumferential or jacket surface of the impression cylinder and the upline transfer region of the same impression cylinder.

SUMMARY OF THE INVENTION

It is an object of the invention to provide a method and a device for removing particles lying on or entrained by single-layer or multilayer webs of material during processing operations, which are improvements over heretofore known methods and devices of this general type.

With the foregoing and other objects in view, there is provided in accordance with one aspect of the invention, a method for removing from at least single-layer webs of material, particles formed by slitting devices which are arranged along a web travel path in a slitting zone, which comprises generating a suction zone associated with the slitting devices in accordance with the position of a cutting location location or point.

In accordance with another mode, the method includes effecting the suction zone by deflecting flexible elements for delimiting a suction device.

In accordance with a further mode, the method includes deflecting the flexible elements by displacing elements for producing the deflections of the flexible elements in a forcibly coupled manner with the slitting devices.

In accordance with another aspect of the invention, there is provided a device for removing from at least single-layer webs of material, particles formed by slitting devices arranged along a web travel path in a slitting zone, comprising deflection elements movable parallel to an axis of rotation of the slitting devices for deflecting elements forming a suction zone, the deflection elements being coupled to the slitting devices.

In accordance with a further feature of the invention, the elements forming the suction zone are constructed as flexible brushes.

In accordance with an added feature of the invention, the elements forming the suction zone are flexible and are constructed as lamellar displaceable elements.

In accordance with an additional feature of the invention, the elements forming the suction zone delimit an opening formed in a suction device.

In accordance with yet another feature of the invention, the deflecting elements are held on a bearing plate of one of the slitting devices.

In accordance with yet a further feature of the invention, the particle-removing device includes a drive for displacing the bearing plate in a given direction of displacement.

In accordance with yet an added feature of the invention, the direction of displacement extends perpendicularly to the travel direction of the web of material.

In accordance with yet an additional feature of the invention, the suction device comprises a vacuum box with lateral vacuum ports.

In accordance with still another feature of the invention, the suction device is formed with an opening covered by deflectable elements.

In accordance with still a further feature of the invention, the deflectable elements are arranged in rows or series.

In accordance with still an added feature of the invention, the deflection elements comprise a rounded contour.

In accordance with still an additional feature of the invention, the deflection elements are capable of generating a suction zone lying in the web travel plane and extending into an outlet wedge of the mutually cooperating slitting devices.

In accordance with a third aspect of the invention, there is provided a jobbing web-fed rotary printing machine having a device for removing from at least single-layer webs of material, particles formed by slitting devices arranged along a web travel path in a slitting zone, comprising deflection elements movable parallel to an axis of rotation of the slitting devices for deflecting elements forming a suction zone, the deflection elements being coupled to the slitting devices.

In accordance with a fourth aspect of the invention, there is provided a newspaper rotary printing machine having a device for removing from at least single-layer webs of material, particles formed by slitting devices arranged along a web travel path in a slitting zone, comprising deflection elements movable parallel to an axis of rotation of the slitting devices for deflecting elements forming a suction zone, the deflection elements being coupled to the slitting devices.

In accordance with another mode, the method includes situating the slitting zone in a turner-bar superstructure of a web-processing rotary printing machine.

In accordance with a further feature of the invention, the slitting zone is situated in a turner-bar superstructure of a web-processing rotary printing machine.

The advantages associated with the solutions according to the invention are that, when the position of the slitting device is adjusted, the suction zone is automatically set to the position of the new cutting location or point without special actions being required on the part of the pressman. The suction zone, which is adapted to the position of the current cutting location, extends as far as into the outlet pocket of the two mutually cooperating cutting tools, so that particles such as paper dust or the like can be removed immediately from the top or bottom side of the web of material, which may also be multilayered, at the location at which they are formed; the suction therefore removes the particles directly at the location at which they are formed and prevents them, when moving past guide rollers, from being impressed into the top and bottom side of the respectively outermost paper webs of multilayer paper webs.

In a further configuration of the concept upon which the invention is based, with the method according to the invention, a suction zone is defined by a deflection of flexible elements which delimit a suction device. If the elements which produce the deflection are coupled to the slitting devices, the zone which sucks out the particles is inevitably generated in accordance with the displacement position of the slitting tools by adapted deflection of flexible elements. Thus, there is no need for readjustment by the pressman, and the position of the suction zone is automatically adjusted to the corresponding position of the slitting tools; where the following text refers to one slitting device, it is also intended to mean a plurality of slitting devices which can be adjusted independently of one another transversely with respect to the travel direction of the webs of material.

According to the device for removing particles from webs of material which is also proposed in accordance with the invention, the elements which are respectively assigned to a slitting device and form the suction zone may be constructed as flexible brushes or tufts of bristles. These are advantageously arranged so that they close off an opening, which extends across the width of the web of material, in the vacuum box of the suction device, only those flexible brush elements which form the suction zone being deflected, and the opening in the vacuum box being kept closed by the brush elements which are arranged in series or rows and are not deflected.

To set individual working positions of the slitting devices, the bearing plates thereof may be driven in a manner that they can be displaced transversely to the web travel direction. The suction device, which is installed in a stationary position and is preferably arranged beneath the web of material, is formed by a vacuum box, of which the opening, which is positioned in the web travel direction, is closed by the flexible brush elements which, when not deflected, are in a vertical orientation. When the brush elements are deflected by a deflection element held on the displaceable bearing plate of the slitting tools and preferably having a uniformly rounded external contour, a suction region which lies in the web travel plane is produced and preferably extends beneath the exiting web of material as far as into the outlet pocket of the mutually cooperating cutting tools.

The solution according to the invention can advantageously be used in web-processing Jobbing or newspaper printing machines wherein single-layer or multilayer webs of material are slit into web strands in accordance with the product configuration to be produced and are then guided above one another.

Other features which are considered as characteristic for the invention are set forth in the appended claims.

Although the invention is illustrated and described herein as a method and a device for removing particles from webs of material, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

DESCRIPTION OF THE PREFERRED EMBODIMENTS

Figure 1:
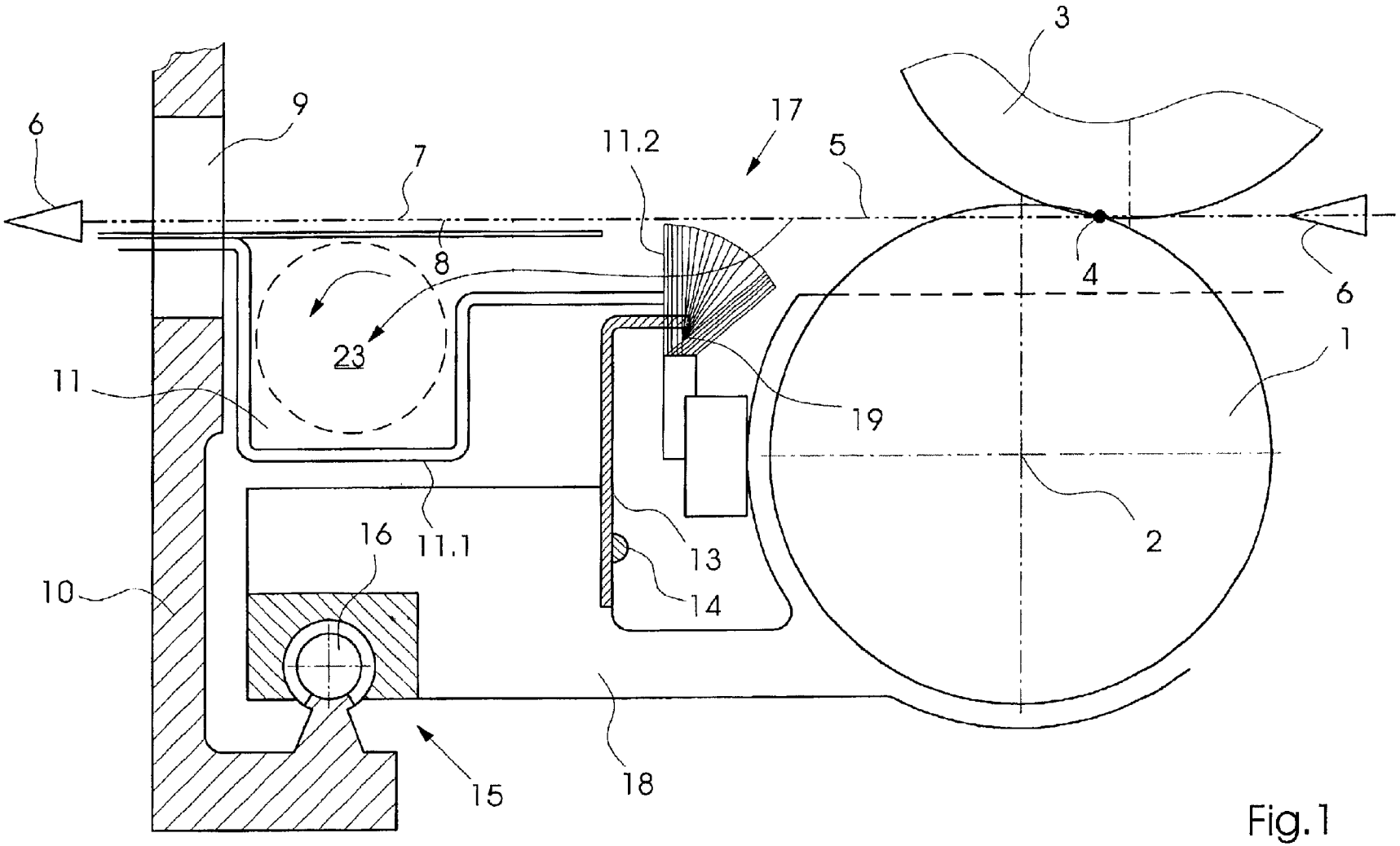
FIG. 1 is a side elevational view, partly in section, of a device for removing particles, according to the invention.

Referring now to the drawings and, first, particularly to FIG. 1 thereof, there is shown therein a driven slitting cutter 1, which rotates about an axis of rotation 2. The cutter 1 is disk-shaped and cooperates with a mating or counter cutter 3. At the cutting location 4 extending in the conveying plane of the web of material 5, the single-layer or multilayer web of material 5, which is moving past, is slit. Depending upon the thickness of the single-layer or multilayer web of material 5 which is to be separated longitudinally in the web travel direction 6, the slitting tools 1, 3 can preferably be brought towards one another or moved away from one another by cutting-depth adjustment devices (not shown in more detail here).

According to the web travel direction 6, which could also extend in the vertical direction or may be reversed by 180°, the web of material 5, in the exemplary embodiment shown in FIG. 1, runs through an opening 9 which lies in the web travel plane. The opening 9 allows the single-layer or multilayer web of material 5 to pass through a spindle carrier 10 wherein there is a vacuum box 11 which extends perpendicularly to the web travel direction 6, and has a subatmospheric pressure, indicated by the arrows, prevailing therein. The vacuum box 11 is provided with an opening 11.2 which is closed off by flexible elements 17 which are arranged so that they stand upright and, in an undeflected state, extend in the vertical direction. The flexible elements 17 may, for example, be constructed as upright brushes, a number of which, in the illustrated exemplary embodiment, have been deflected by a deflection angle bracket 19, which is formed on a deflection finger 13, towards the mutually cooperating cutting tools 1 and 3.

The deflection finger 13, which is formed by a deflection angle bracket 19 which has been angled off through 90°, is attached to a bearing plate 18. The illustrated deflection angle bracket 19 is angled off at a 90° angle, however, this angle bracket could also be arranged at a different angle from 90° in the deflection finger 13. The deflection finger 13 can be arranged so that it is easy to exchange on the bearing plate 18 by an attachment element or fastener 14; it is readily possible to exchange the deflection finger 13 with a deflection angle bracket 19 which is formed with a specific rounding 25 (note FIG. 2) on the bearing plate 18, for example, in order to generate a suction zone 26 (note FIG. 3) of different geometry.

Through the intermediary of a drive 15, which is only diagrammatically represented in FIG. 1, the bearing plate 18 can be moved, for example, by a spindle drive 16, perpendicularly to the plane of the drawing in FIG. 1; the fact that the deflection finger 13 is held on the bearing plate 18 means that it is also moved parallel to the axis of rotation 2 of the cutting blade 1, perpendicularly to the plane of the drawing. As a result, the suction zone 26 is generated, opposite the cutting point 4 in the web travel plane, it being possible for the suction zone 26 to be symmetrical to the cutting point 4.

The shape of the vacuum box 11 of the suction system 23 is selected so that a delimiting or boundary wall 11.1 and the opening 11.2 allow space for the arrangement of a deflection finger 13 on the bearing plate 18, optimum utilization of space beneath the web of material 5 being desired, on the one hand, and the installation of a deflection finger 13 which generates a sufficiently dimensioned suction zone 26, on the other hand, being possible. The farther the deflection angle 19 which deflects the flexible brushes 17, for example, is oriented towards the roots of the brushes, the farther the flexible elements 17 can be deflected towards the outlet pocket of the mutually cooperating cutting tools 1 and 3, and the farther a suction zone 26 which is established in accordance with the position of the cutting point 4 extends.

Figure 2:
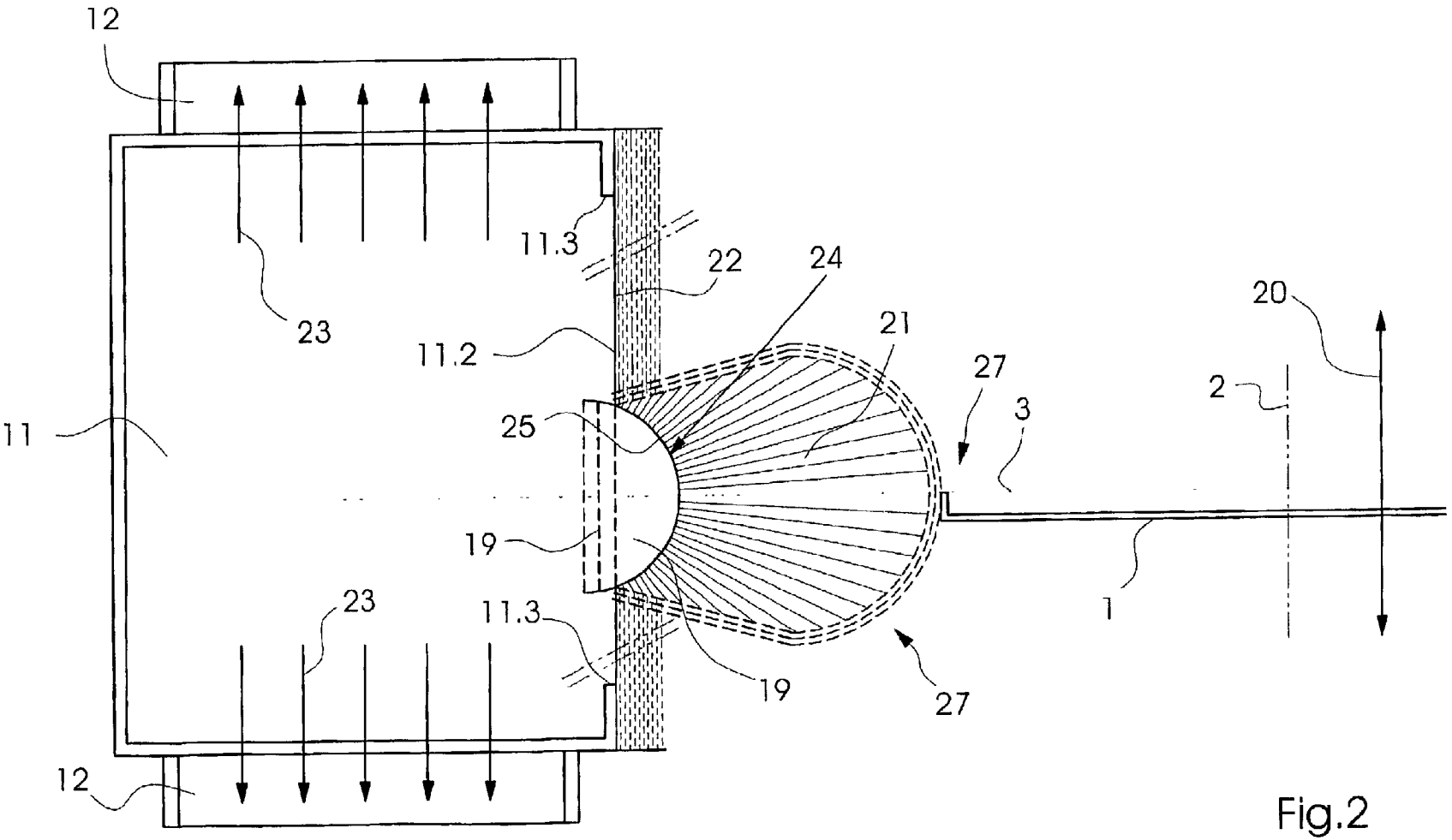
FIG. 2 is a plan view of FIG. 1, showing a suction zone facing the splitting tools.

Furthermore, it can be seen from the plan view of the device according to the invention for removing particles which is shown in FIG. 2 that the suction zone 26, at which the subatmospheric pressure generated in the vacuum box 11 in accordance with FIG. 1 is present, lies inside the zone where the web of material 5 leaves the slitting zone 27. The slitting cutter 1 which is rotating about the axis of rotation 2 cooperates with the mating or counter cutter 3, which is only diagrammatically depicted here, in order to make a cut in single-layer or multilayer webs of material 5. Both slitting tools 1 and 3 are held on the bearing plate 18 shown in FIG. 1.

The instant the bearing plate 18 shown in FIG. 1 changes position transversely with respect to the web travel direction 6, in the direction of displacement indicated by the double-headed arrow 20 by the drive 15, it is displaced relative to the vacuum box 11, which is held in a stationary position. Because the opening 11.2 of the vacuum box is closed off by the flexible, deflectable brush elements 17, a deflected brush region 21 is always produced opposite the slitting zone 27 by the deflection finger 13, due to the fact that the latter is coupled to the bearing plate 18 on which the driven slitting elements 1 and 3 are also held. As a result, the paper dust which is formed during the slitting of the single-layer or multilayer webs of material 5 can be sucked out immediately at the location where it is formed without any possibility of it being entrained by the boundary layers which are being formed and are present at the top and bottom sides of the web of material and, in this way, being conveyed away undesirably. If the suction system 23 is connected to a controllable vacuum source, the subatmospheric pressure in the vacuum box 11 can be adjusted according to the number of layers in the web of material 5 being slit in the slitting zone 27, so that it is possible to adapt the suction air flow which removes the particles to the amount of particles which is to be expected to form as a function of the number of webs of material to be cut.

It is believed to be apparent from the plan view of the vacuum box 11 according to FIG. 2 that the particles are removed through the laterally provided connection pieces 12. Suction connections may be connected to these connection pieces, in which case the two connection pieces 12 may be acted upon either via a common vacuum source or via, respectively, a separate vacuum source. The opening 11.2 on the front of the suction box 11 is delimited by two edges 11.3, in front of which the undeflected region 22 of the brush elements 17 extends with an orientation perpendicular to the web travel direction 6 and parallel to the axis of rotation 2. Furthermore, the rounding 25 on the deflection angle bracket 19 of the deflection finger 13 can be seen from the plan view shown in FIG. 2. In addition to the illustrated rounding 25, the deflection angle bracket 19 may also be constructed with an oval contour or may have a contour which allows another suitable deflection-region configuration. Depending upon the selected contour on the deflection angle bracket 19 of the deflection finger 13, a suction zone 26 which projects into the outlet region of the mutually cooperating cutting tools 1 and 3 is established. The suction zone 26 is established automatically during the movement, which is initiated by remote control, of the slitting tools 1 and 3 in the direction of displacement 20 transversely with respect to the travel direction 6 of the web of material, without further action on the part of the pressman. The vacuum box 11 can easily be removed laterally from the opening in the spindle carrier 10 in order to perform cleaning tasks, and furthermore the deflection finger 13 on the bearing plate 18 can be removed and replaced by a deflection finger 13 of different geometry.

Although only one slitting device is shown in FIG. 2, it is possible for a plurality of such units to be provided over the width of a single-layer or multilayer web of material 5, in order to combine individual web strands for copies which are to be produced according to type and format. It is also possible for the slitting devices 1 and 3 to approach respective preset positions, which are fixed as a function of format, as part of the presetting of the rotation by a central control unit.

The solution which is proposed in accordance with the invention allows the extraction of the particles which may form during the slitting to take place directly where they are formed, without the occurrence of any entrainment of the particles by the boundary layer which forms on the top side 7 and the bottom side 8 of the web of material 5 and, in this way, being conveyed away. At web velocities of approximately 15 m/s, particles contained in the boundary layer on both sides of the web of material 5 can be removed only by a suction air flow with a velocity in the order of magnitude of approximately 25 m/s. However, a high suction air velocity of this nature requires corresponding blowers and corresponding drive work which, with the solution proposed according to the invention, can advantageously easily be economized on or saved.

Figure 3:
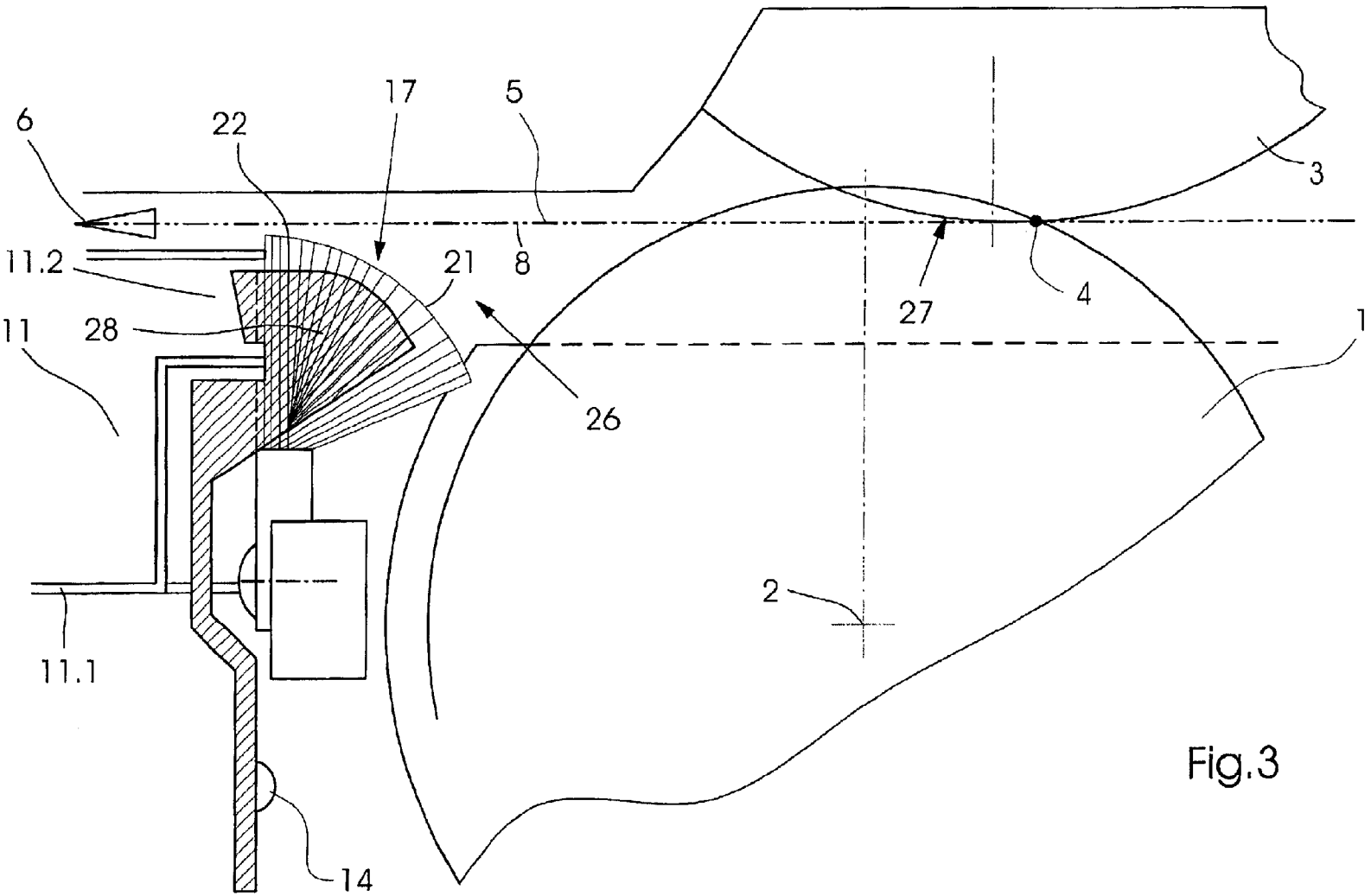
FIG. 3 is a view like that of FIG. 1 of a different embodiment of the device according to the invention, and showing a semicircular support which encompasses a deflection element.

FIG. 3 shows a different embodiment with a semicircular support which encompasses the deflection elements.

Analogous to the illustration which has already been discussed with regard to FIG. 1, the web of material 5 runs in the web travel direction 6 and, at the cutting point 4, is cut in the longitudinal direction by the cutters 1 and 3 which cooperate with one another. After leaving the cutting zone between the cooperating cutters 1 and 3, the web of material 5, which is conveyed in the web travel direction 6, passes into a suction zone 26, which may be formed, for example, by locally deflected brushes 17. In the illustration shown in FIG. 3, the brushes 17 are encompassed, in their deflected state, by a support 28 which is provided with a rounding 30 (note FIG. 4). The inclined rounding 30 inside the support 28 determines the maximum deflection in the deflected brush region 21 relative to the undeflected brush region 22.

Instead of the brushes shown in FIGS. 1 and 3, respectively, it is also possible to provide elements which are displaceable inside one another in lamellar fashion and restrict the effected deflection region 21 by the deflection angle bracket 19. The elements which are displaceable inside one another in lamellar fashion may be made from plastics or other materials and are constructed so that the suction zone 26, which is illustrated in FIG. 2 and is configured approximately in the form of a roof tile, is formed.

On the sides thereof, the support 28 encompassing the deflected brush region 21 is delimited or bounded by side faces 29 which, therebetween, enclose the rounding 30. The support 28, which is provided with an inclined support surface, is attached to the vacuum box 11 by the fastener 14.

Figure 4:
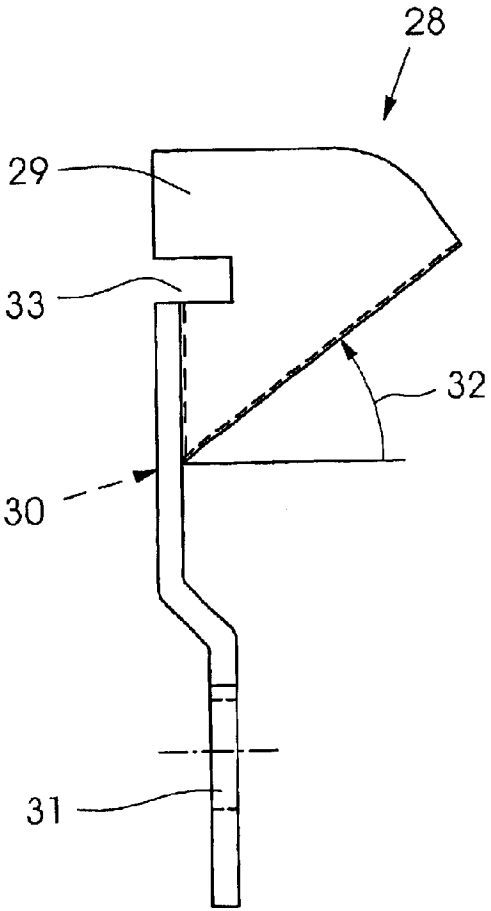
FIG. 4 is a side view of the semicircular support shown in FIG. 3.

A side view of the semicircular support is shown in FIG. 4.

The support 28 has a rounded region 30 (note FIG. 5), which is constructed to run with an inclination 32 with respect to the horizontal. The base of the rounding 30, represented by broken lines in FIG. 4, may, for example, be constructed as a thin metal sheet which defines the maximum deflection of brushes 17 or the maximum displacement travel of lamellar delimiting elements.

The support 28 is of crankshaped construction and is formed with a recess 33 wherein a delimiting or boundary wall 11.1 of the vacuum box 11 opens out, at which vacuum box the support 28 is held by an attachment element or fastener 14. The support 28 may be produced both as a metal component and as a component formed from plastic material.

Figure 5:
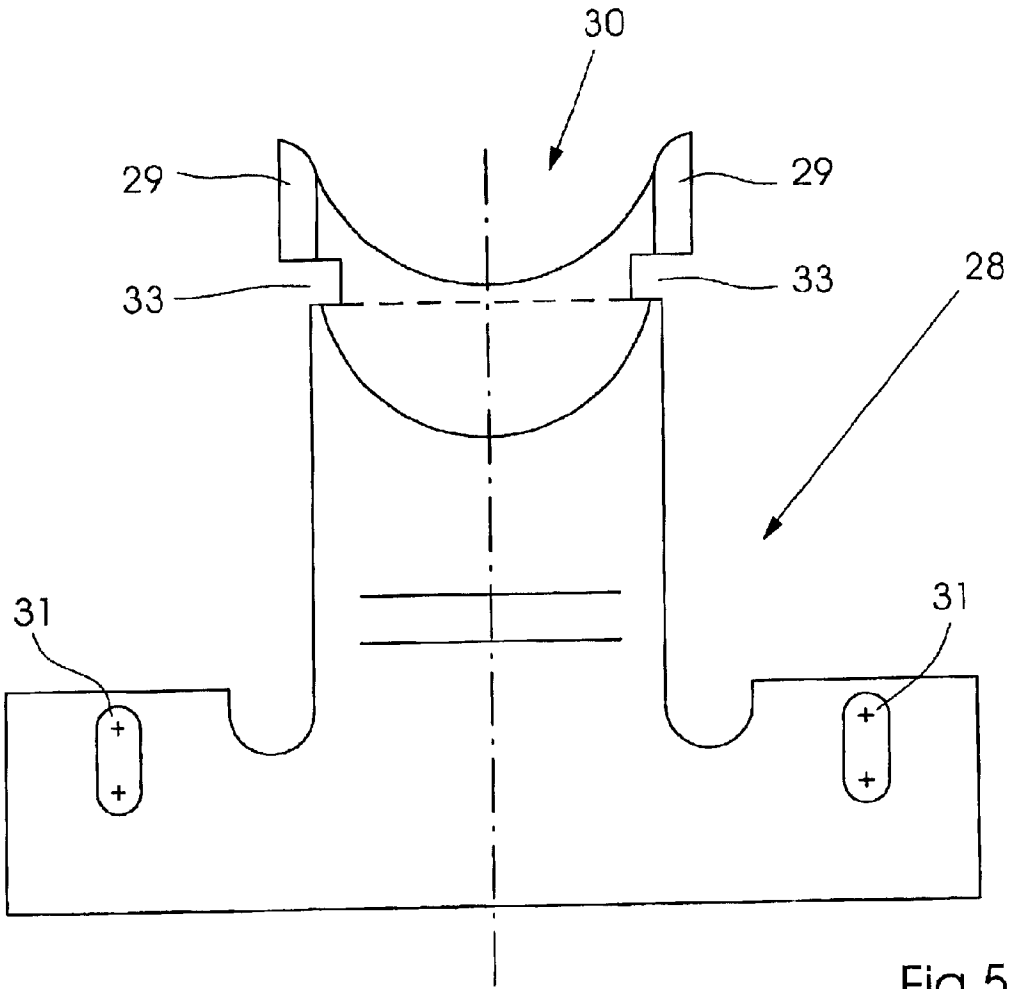
FIG. 5 is a plan view of the semicircular support illustrated in FIG. 4.

FIG. 5 is a plan view of the semicircular support shown in FIG. 4.

The support 28, whether it be a plastic or metal component, can be held on the vacuum box 11 (note FIG. 3) by an attachment element or fastener 14 which passes through the support in the region of the slots 31. In the upper part of the support 28, the rounding 30, formed with an inclination 32, is shown, the base surface and the side faces 29, which are held thereon, of the rounding 30 serving to delimit or bound the maximum deflection of the brush-like or lamellar displacement elements. The support 28 with the recess 33, as illustrated in FIGS. 4 and 5, rests on the delimiting wall 11.1 of the vacuum box 11, in a turner-bar superstructure disposed downline of the slitting device.

I claim:

1. A device for removing from at least single-layer webs of material, particles formed by slitting devices arranged along a web travel path in a slitting zone, comprising:

a plurality of elements;

a suction device on a first side of said elements;

slitting devices on a second side of said elements;

a deflection bracket movable parallel to an axis of rotation of the slitting devices for deflecting said elements to create a suction zone on said second side of said elements, said deflection bracket being couple to the slitting devices.

2. The particle-removing device according to claim 1, wherein said elements are constructed as flexible brushes.

3. The particle-removing device according to claim 1, wherein said elements are flexible and are constructed as lamellar displaceable elements.

4. The particle-removing device according to claim 1, wherein said deflecting elements are held on a bearing plate of one of the slitting devices.

5. The particle-removing device according to claim 4, including a drive for displacing said bearing plate in a given direction of displacement.

6. The particle-removing device according to claim 5, wherein said direction of displacement extends perpendicularly to the travel direction of the web of material.

7. The particle-removing device according to claim 1, wherein said suction device comprises a vacuum box with lateral vacuum ports.

8. The particle-removing device according to claim 1, wherein said suction device is formed with an opening covered by said elements.

9. The particle-removing device according to claim 8, wherein said elements are arranged in rows.

10. The particle-removing device according to claim 1, wherein said deflection bracket comprises a rounded contour.

11. The particle-removing device according to claim 10, wherein said deflection bracket is capable of generating a suction zone lying in the web travel plane and extending into an outlet wedge of the mutually cooperating slitting devices.

12. A jobbing web-fed rotary printing machine having a device for removing from at least single-layer webs of material, particles formed by slitting devices arranged along a web travel path in a slitting zone, comprising:

a plurality of elements;

a suction device on a first side of said elements;

slitting devices on a second side of said elements;

a bracket movable parallel to an axis of rotation of the slitting devices for deflecting said elements to create a suction zone on said second side of said elements, said deflection bracket being coupled to the slitting devices.

13. A newspaper rotary printing machine having a device for removing from at least single-layer webs of material, particles formed by slitting devices arranged along a web travel path in a slitting zone, comprising:

a plurality of elements;

a suction device on a first side of said elements;

slitting devices on a second side of said elements;

a deflection bracket movable parallel to an axis of rotation of the slitting devices for deflecting said elements to create a suction zone on said second side of said elements, said deflection bracket being coupled to the slitting devices.

14. The particle-removing device according to claim 1, wherein the slitting zone is situated in a turner-bar superstructure of a web-processing rotary printing machine.

15. The jobbing web-fed rotary printing machine according to claim 12, wherein the slitting zone is situated in a turner-bar superstucture of the machine.

16. The newspaper rotary printing machine according to claim 13, wherein the slitting zone is situated in a turner-bar superstructure of the machine.

* * * * *